United States Patent [19]

Lowther

[11] Patent Number: 4,982,631

[45] Date of Patent: Jan. 8, 1991

[54] MECHANIC'S TUBING PLUG

[76] Inventor: John K. Lowther, 5780 Barrett Rd., Colorado Springs, Colo. 80926

[21] Appl. No.: 525,693

[22] Filed: May 21, 1990

[51] Int. Cl.[5] ..... B25B 7/02

[52] U.S. Cl. ..... 81/426; 81/419; 29/268

[58] Field of Search ..... 81/426, 418, 419, 420, 81/424.5, 426.5, 421, 422, 423, 485, 486, 487, 488; 29/278, 270, 268, 235; 269/6, 275

[56] References Cited

U.S. PATENT DOCUMENTS

| | | | |
|---|---|---|---|
| 1,707,640 | 4/1929 | Pade | 29/235 |
| 3,314,320 | 4/1967 | Early | 81/419 |
| 4,017,958 | 4/1977 | Diggs | 29/26 B |
| 4,170,125 | 10/1979 | Minka | 81/426 X |
| 4,222,985 | 9/1980 | Greenleaf | 81/424.5 X |
| 4,881,434 | 11/1989 | Keller | 1/426 |

*Primary Examiner*—D. S. Meislin
*Attorney, Agent, or Firm*—Linval B. Castle

[57] ABSTRACT

A tubing plug for temporarily sealing flared end tubing includes an adjustable, locking jaw pliers such as a Vise-Grip type having a plate secured to each jaw. One plate is slotted to receive and hold the end of the flared tubing; a resilient neoprene cone is attached to the other plate with the apex of the cone aligned with the bore of the tubing.

5 Claims, 1 Drawing Sheet

MECHANIC'S TUBING PLUG

BRIEF SUMMARY OF THE INVENTION

This invention relates generally to hand tools and particularly to a tool for quickly and temporarily sealing a flared tubing end.

During the overhaul of a vehicle brake system, the mechanic usually finds it necessary to remove a tubing containing hydraulic brake fluid and to temporarily seal the line to prevent the excess loss of fluid. Similarly, refrigeration technicians must seal an opened line to prevent excess loss of refrigerant. In these and other similar cases, it is important that the opened line be quickly and thoroughly sealed for a temporary period for the repair or replacement of some component.

The method for temporarily sealing the end of a hydraulic tubing usually includes the forcing of a wooden plug into the tubing to, at least, slow any leakage from the tubing. Or the flare nut on the tubing will occasionally be screwed onto a sealed male tube fitting for a complete but temporary seal that requires somewhat longer to install. The tubing plug to be described is very quickly installed on a flared tubing end and provides a complete seal that is quickly removable.

Briefly described, the tubing plug of the invention comprises an adjustable, locking-jaw, quick-release pliers. Secured to a first jaw of the pliers is a plate supporting a conical shaped resilient plug facing a plate secured to the second jaw and having a slot into which is fitted the tubing. When a hydraulic tubing is disconnected from some member the flared tube end is quickly passed into the slot and the pliers jaws are closed to drive the conical resilient plug tightly into the tube end for a thorough seal. When ready for reattachment of the hydraulic tubing, the quick release trigger is actuated so that the plug is very quickly withdrawn from the tube end and the tubing is removed from the slot and reattached.

BRIEF DESCRIPTION OF THE DRAWINGS

In the drawings which illustrate the preferred embodiment of the invention.

DETAILED DESCRIPTION

Figure 1:
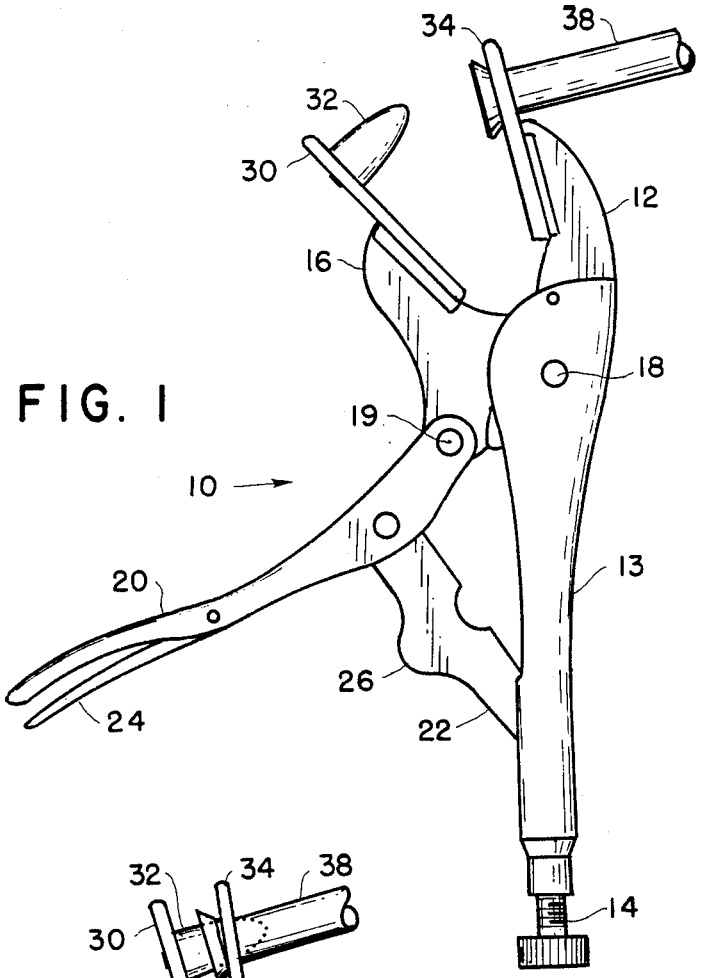
FIG. 1 is a side elevational view illustrating the mechanic's tubing plug with open jaws and with a flared tubing in position for sealing.

FIG. 1 shows an adjustable, locking, quick-release pliers 10 usually referred to as Vise-Grip pliers. These pliers include a stationary jaw 12 attached to a handle 13 containing a manually adjustable screw 14 longitudinally movable within the handle. A second jaw 16, coupled to the stationary handle 13 at a pivot 18 is also pivoted at pivot 19 to the end of a second handle 20 which, in turn, is pivoted to a lever member 22 the free end of which bears against the end of the adjustable screw 14 within the stationary handle.

Thus, as shown in FIG. 1, moving the handle 20 toward the stationary handle 13 will force the pivot 19 upward and cause the second jaw 16 to rotate clockwise around pivot 18 to thereby close against the stationary jaw 12. If the screw 14 is in proper adjustment, the lever member 22 will be drawn within the tubular stationary handle 13 and the pivots in the adjustable second handle 20 will form an over-center lock which will prevent normal separation of the handles and jaws. To provide easy opening, an opening trigger 24 pivoted into the interior of the second handle 20 and positioned to bear against a protruding portion 26 of the lever member 22 within the stationary handle 12 may be slightly and easily moved to quickly pry and separate the second handle 20 from the stationary handle 12.

The invention is for the attachment to the pliers jaws 12, 16, members which can grasp a hydraulic tubing and quickly and temporarily seal it against leakage As previously noted, such a hand tool will be a valuable asset in brake overhauling or air conditioner repairs.

As shown in FIG. 1, a strong steel plate 30 is welded or otherwise attached to the second jaw 16. The flat base of a conical plug 32, formed of neoprene or other resilient, oil-resistant material is attached to the plate with its apex facing the stationary jaw 12. The diameter at the base of the plug 32 must be larger than the inside diameter of a tube to be sealed and the apex must be nearly pointed so that the plug will readily enter the flared ends of all tubes for which the tool is adapted.

Figure 2:
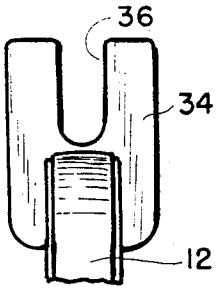
FIG. 2 is a view of the U-shaped jaw plate for securing a flared tubing end.

A second plate 34 is attached to the stationary jaw 12. As shown in FIG. 2, plate 34 has a longitudinal slot 36 having a width slightly larger than the outside diameter of a tube to be sealed by the conical plug 32. The plate 34 is normally welded to the stationary jaw 12 so that the tool will be used for only the one or two diameter tubes having flared ends that cannot pass through the slot 36. If desired, plates 34 with different slot widths may be secured to the jaw 12 by screws so that a single tool may be used to seal flared end tubing of various diameters.

Figure 3:
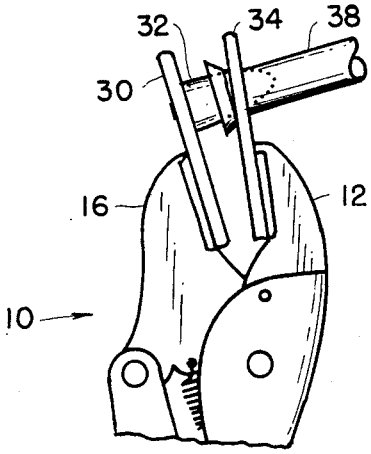
FIG. 3 illustrates the mechanic's tubing plug of FIG. 1 with jaws closed to seal the tubing.

FIG. 3 illustrates a section of the tool 10 with jaws 12, 16 closed. An end section of a tube 38 is shown with its flared end retained by the narrower width of the slot 36. The closing of jaws 12, 16 is shown to have forced the resilient conical plug 32 into the tube end to completely seal the tube. To quickly release the plug 32 from the tube, it is only necessary to press together the opening trigger 24 and the second handle 20.

I claim:

1. A mechanic's tool for temporarily sealing the end of a tube having a flared end, said tool comprising:

a pliers having first and second jaws, each jaw coupled to a jaw controlling handle;

locking means included in said pliers for locking said first and second jaws in a closed position;

clamping means attached to said first jaw for securing the end portion of a tubing with the flared end of said tubing generally aligned toward said second jaw; and a conical resilient plug attached to said second jaw; said plug having its apex generally pointing toward said clamping means.

2. The mechanic's tool claimed in claim 1 wherein said clamping means is a metal plate having a slot width for receiving the tube but less than the diameter of the flared end of the tube.

3. The mechanic's tool claimed in claim 2 wherein said conical resilient plug is attached to a plate coupled to said second jaw at a position at which said plug apex is generally aligned into the center of said slot.

4. The mechanic's tool claimed in claim 3 wherein said slot is aligned substantially parallel with the longitudinal axis of said pliers.

5. The mechanic's tool claimed in claim 3 wherein said pliers is a Vise-Grip type pliers.

* * * * *